United States Patent [19]

Kim et al.

[11] Patent Number: 5,036,171

[45] Date of Patent: Jul. 30, 1991

[54] ELECTROMAGNETIC WAVE ENERGY SEAL ARRANGEMENT

[75] Inventors: Eung S. Kim; Byung J. Kim; Seong J. Ahn, all of Seoul, Rep. of Korea

[73] Assignee: Goldstar Co., Ltd., Seoul, Rep. of Korea

[21] Appl. No.: 505,513

[22] Filed: Apr. 6, 1990

[30] Foreign Application Priority Data

Apr. 6, 1989 [KR] Rep. of Korea ..... 4552/1989

[51] Int. Cl.[5] ..... H05B 6/76

[52] U.S. Cl. ..... 219/10.55 D; 174/35 GC

[58] Field of Search ..... 219/10.55 D, 10.55 R; 174/35 R, 35 GC

[56] References Cited

U.S. PATENT DOCUMENTS

| | | | |
|---|---|---|---|
| 4,449,025 | 5/1984 | Ikeda et al. | 219/10.55 D |
| 4,523,069 | 6/1985 | Staats | 219/10.55 D |
| 4,584,447 | 4/1986 | Kusunoki et al. | 219/10.55 D |
| 4,700,034 | 10/1987 | Lee | 219/10.55 |
| 4,742,201 | 5/1988 | Nakano et al. | 219/10.55 D |
| 4,868,359 | 9/1989 | Iwabuchi et al. | 219/10.55 D |

*Primary Examiner*—Philip H. Leung

*Attorney, Agent, or Firm*—Birch, Stewart, Kolasch & Birch

[57] ABSTRACT

An electromagnetic wave energy seal for a microwave oven comprises a λg/4 choke seal including an internal plate for forming a first capacitive seal, an external plate for forming a recessed chamber with an external plate, a stepped portion having a vertical portion, slots formed with predetermined periodical intervals, a bent portion for forming a second capacitive seal, and a choke cover for blocking the opening of the recessed chamber, whereby the radio frequency leakage can be perfectly prevented from a heat cavity of the microwave oven and the thickness of a door of the microwave oven can be reduced.

1 Claim, 5 Drawing Sheets

ELECTROMAGNETIC WAVE ENERGY SEAL ARRANGEMENT

BACKGROUND OF THE INVENTION

1. Field of the Invention

The present invention relates to an electromagnetic wave energy seal arrangement for a microwave oven and particularly, to a choke seal member for a door of a microwave oven in which the leakage of electromagnetic wave energy through a gap between the door and a front panel of a heating cavity of the microwave oven can be effectively prevented from the heating cavity and also the thickness of the door of the microwave oven can be reduced.

2. Description of the Prior Art

Various types of microwave ovens are well known in the art as a useful kitchen utensil which cooks foods by producing heat from food itself by radiating high frequency electromagnetic wave generated from a magnetron to foods within a hating cavity. However, when the electromagnetic wave generated from the magnetron in such microwave ovens is radiated to the human body over a predetermined quantity, fatal harm may be inflicted to the human body. Therefore, the leakage of the electromagnetic wave to exterior from the heating cavity of such microwave ovens should be prevented.

It is inevitable that such microwave ovens used in general are made to have a predetermined gap between the door and the front panel of a heating sanity in their structure. Therefore, in order to prevent the leakage of electromagnetic wave energy through the gap, generally a capacitive seal, a λg/4 choke seal (λg is the wavelength of electromagnetic wave within the heating cavity), and a ferrite rubber which is a high frequency absorption material, are widely known and having been used.

Such a conventional electromagnetic wave energy leakage preventing device is described in FIG. 2. As shown in FIG. 1, the microwave oven includes a main body 1, a door 2 for opening and closing a heating cavity 8, a glass 3 for viewing through the interior attached to the door 2 so as to be able to see the interior of the heating cavity 8, which is mounted with keeping a predetermined distance with an external glass 3' (FIG. 2). FIG. 2 shows the structure of a choke seal for preventing electromagnetic wave energy leakage formed along with a circumferential edge of the door 2, wherein as shown in the drawing, the substantially rectangular λg/4 recessed chamber 6 having a predetermined length L and width W is formed by internal and external plate members 5 and 4. The internal plate member 5 is bent in its bottom end portion toward the recessed chamber 6 about the intermediate portion of the choke channel 6. An opening 6' is formed at its lower side and also, the opening 6' is closed with a choke cover 7 made of plastic material which is attached with a ferrite rubber 7a disposed at inside thereof.

And, a capacitive seal is formed between a front panel 1' of the heating cavity 8 and the internal plate member 5 of the recessed chamber 6. A transmission line of the portion where a capacitive seal is formed has wave number of:

$$kn = \sqrt{K_0^2 - \left(\frac{n\pi}{b}\right)^2}, \ (n = 0, \pm 1, \pm 2)$$

wherein, $K_0 = 2\pi/\lambda$, b represents a distance between the front panel 1' and the internal plate member 5. And, wherein when value b is very little, TE mode and TM mode are cutoff and only the transmission is carried out only in the TEM mode. That is, since the characteristic impedance of a parallel transmission line in case of TEM mode is proportional to $$\sqrt[b]{\frac{\mu}{\epsilon}},$$

electromagnetic wave energy leaked from the heating cavity 8 can be reflected by making either the value b to be very little or the value ε to be great, wherein μ is permeability and ε is permittivity.

And, an upper horizontal portion 4a of the external plate member 4 for forming the recessed chamber 6 is a plane that impedance is zero, and if seeing the recessed chamber 6 as a transmission line, as shown in FIG. 3, impedance at a point distanced apart as much as a length l from a load Zl is represented by $$Zin = Zo\,\frac{Zl + jZo\tan\beta l}{zo + jzl\tan\beta l},$$

wherein zo is the characteristic impedance of transmission line, β is a propagation constant, both of which are values determined by the structure of transmission line.

In the above expression, assuming that zl=o, then it becomes Zin=jzo tan βl, when l becomes λg/4, Zin becomes infinity; when l=λg/2, then Zin=o. Therefore, as shown in FIG. 2, in case when the electromagnetic wave energy within the heating cavity 8 is leaked from a point A to a point C, and flowed into the interior of the recessed chamber 6 with a path of B from a point D, the point D is located at a point distanced away as much as λg/4 from a plane 4a where the impedance is zero, so that the impedance of point D becomes infinity. Thus, the recessed chamber 6 produces resonance reflect the electromagnetic wave energy toward the heating cavity 8 and thereby becoming possible to prevent the leakage toward exterior.

However, according to the choke seal of the conventional structure as aforementioned, when the gap between the internal plate 5 of the recessed chamber 6 and the front panel 1' of the heating cavity 8 becomes great, the electromagnetic wave energy is transmitted not only in the TEM mode but also in the TE mode or TM mode, thus λg/4 choke seal becomes impossible to exert its own function. Therefore, the leakage of electromagnetic wave energy is outstandingly increased.

Furthermore, since the λg/4 choke seal and the expensive ferrite rubber are used together, the cost of product is increased and since the length and width of the recessed chamber 6 are relatively long and wide, the thickness of the door 2 becomes thicker, and therefore, there has been a problem that it is difficult to make the product in compact.

SUMMARY OF THE INVENTION

Accordingly, it is an object of the present invention to provide an improved electromagnetic waver energy seal for a microwave oven wherein a stepped portion having periodical slots is formed at the bottom end portion of the internal plate member of a door of the microwave oven for forming the choke seal, and an auxiliary capacitive seal is formed between the bottom end portion of external plate member and the front panel of the heating cavity so that the leakage of the electromagnetic wave energy can be effectively prevented without using the expensive ferrite rubber, as well as the thickness of the door can be reduced.

Another object of the present invention is to provide an electromagnetic wave energy seal including slots with predetermined periodical intervals at a vertical portion of the a stepped portion formed by bending in two steps the bottom end portion of internal plate member of the door of the microwave oven and horizontal portion of lower side bent inwardly toward a recessed chamber extended from the vertical portion, and a C-shaped bent member is formed at the bottom end portion of the external plate member for forming the recessed chamber together with the internal plate member so that an auxiliary capacitive seal is formed between the front panel of the heating cavity and the bent member.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to an electromagnetic wave energy seal for a microwave oven comprising a λg/4 choke seal including an internal plate for forming a first capacitive seal, an external plate for forming a recessed chamber with an external plate, a stepped portion having a vertical portion, slots formed with predetermined periodical intervals, a bent portion for forming a second capacitive seal, and a choke cover for blocking the opening of the recessed chamber, whereby the radio frequency leakage can be perfectly prevented from a heat cavity and the thickness of a door of the microwave oven can be reduced.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
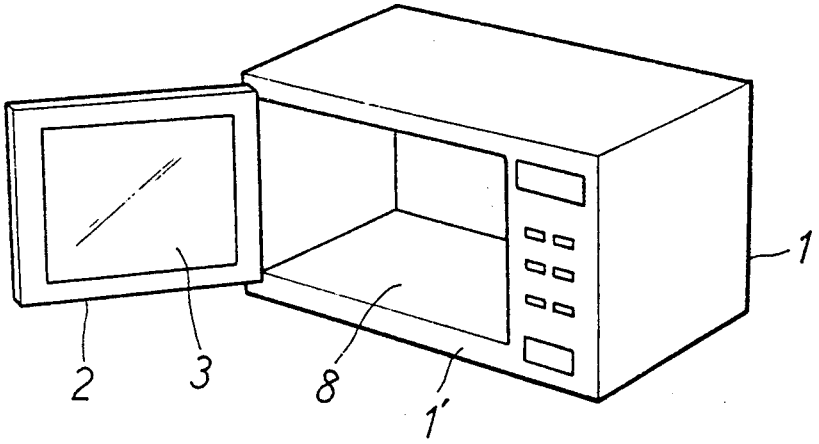
FIG. 1 is a perspective view of the microwave oven of the present invention.
Figure 2:
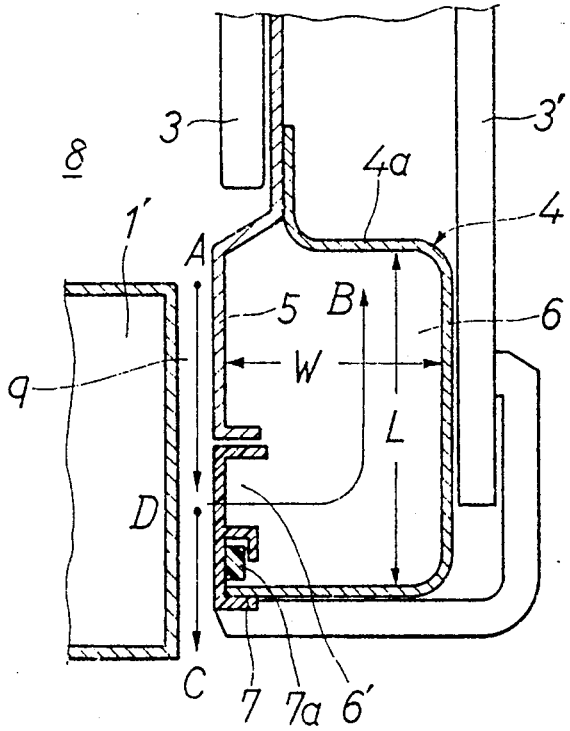
FIG. 2 PRIOR ART
FIG. 2 is a cross sectional view of a choke seal of the conventional microwave oven.
Figure 3:
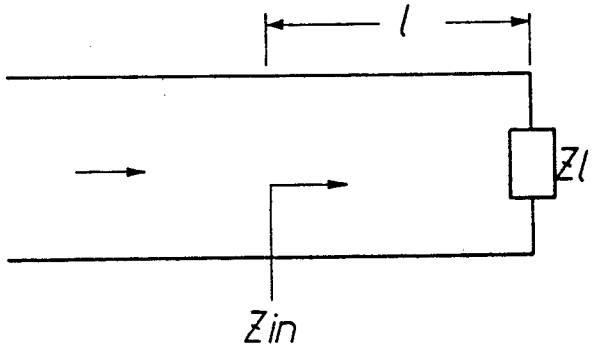
FIG. 3 PRIOR ART
FIG. 3 is an explanatory diagram showing the relation of impedance of the transmission line.
Figure 4:
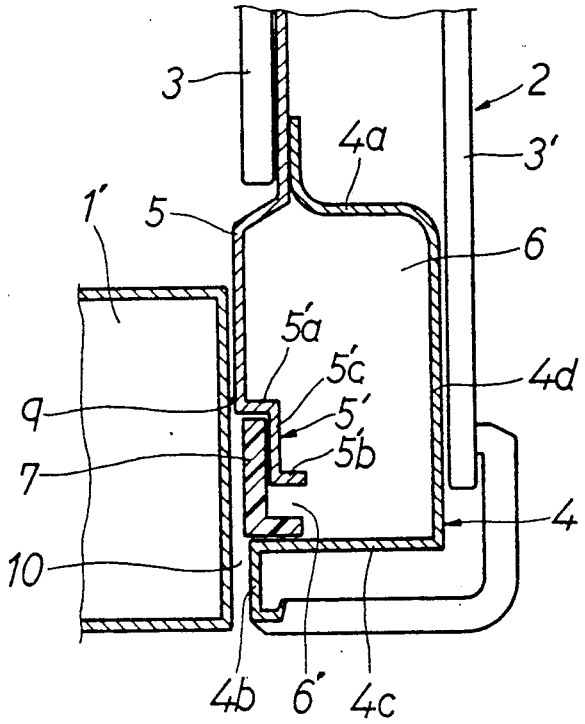
FIG. 4 is a cross sectional view of a choke seal of the microwave oven according to the present invention.
Figure 5:
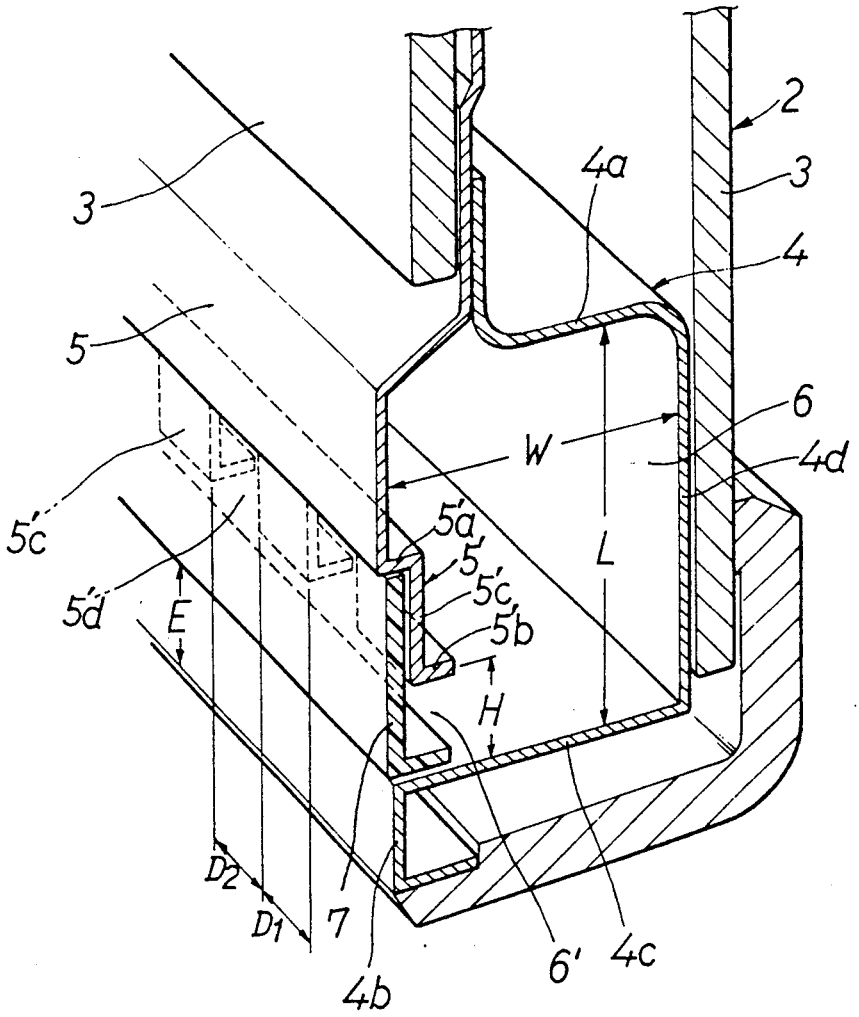
FIG. 5 is an enlarged perspective view of the choke seal containing cut-away portions in order to illustrate the construction of the choke seal according to the present invention.

Hereinafter, a preferred embodiment of the present invention will be described in detail with reference to FIGS. 4 to 9 as follows:

Referring to FIGS. 4 and 5, in which parts similar to those previously described with reference to FIGS. 1 and 2 are denoted by same reference numerals, the electromagnetic wave energy leakage preventing device according to the present invention is same as conventional structure in a manner that an internal plate member 5 and an external plate member 4 of a door 2 are extended and formed, whereby a recessed chamber 6 has a substantially rectangular configuration. A capacitive seal 9 is formed between the internal plate member 5 forming the recessed chamber and an upper portion of a front panel 1'. A stepped portion 5' bent in two step toward the recessed chamber 6 is provided at the bottom end portion of the internal plate member 5. As shown in FIG. 5, slots **5'*d* are formed with a predetermined periodical interval at a lower horizontal portion 5'*b* inwardly bent toward the recessed chamber 6 and a vertical portion 5'*c* of the stepped portion 5'**.

Furthermore, the bottom end of the external plate member 4 is downwardly bent in parallel with the front panel 1', whereby a C-shaped bent portion **4*b* for forming an auxiliary capacitive seal 10 between the front panel 1' is formed and an opening 6' of the recessed chamber 6 formed between the lower horizontal portion 5'*b* of the stepped portion 5' and the upper surface of the bent member 4*b* is made to close with a choke cover 7** made of plastic material.

Figure 6:
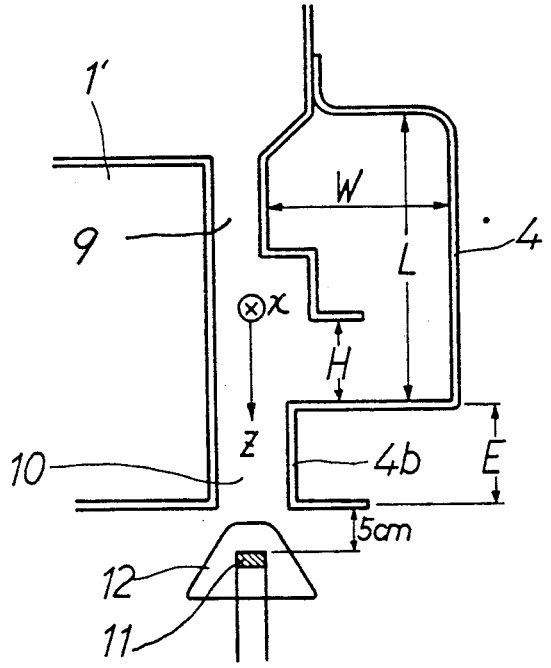
FIG. 6 is an exemplary diagram of a testing equipment to be used to obtain optimum structure of the choke seal according to the present invention.
Figure 8:
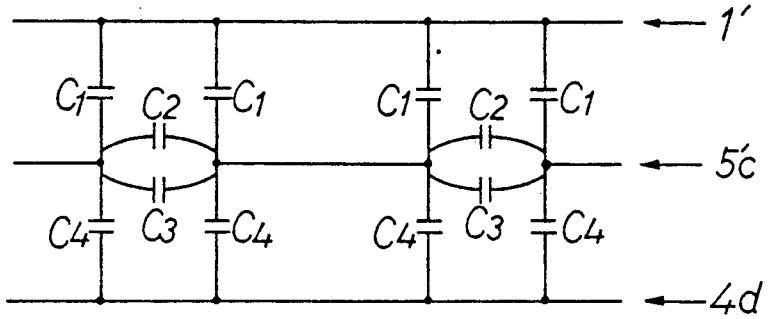
FIG. 8 is an explanatory diagram illustrating a fringing capacitance formed by slots provided in the choke seal according to the present invention.

According to the present invention, the microwave oven operates as follows:

Flow of the electromagnetic wave energy leaked to the exterior from the heating cavity 8 can be expressed by Poynting's vector $\vec{S}=\vec{E}\times\vec{M}$ [mW/cm$^2$] as shown in FIG. 6, wherein $\vec{S}$ represents a component of Z direction, $\vec{E}$ represents a component of x direction, and $\vec{M}$ represents a component of y direction. In order to prevent such vector components, a choke for blocking the proceeding of electromagnetic wave energy toward $\vec{X}$ direction and a choke for blocking the proceeding toward $\vec{Z}$ direction are repectively required. The slots **5'*d* formed periodically at the stepped portion 5' are made to operate as a band stop filter against the electromagnetic wave energy proceeding to $\vec{X}$ direction so that the leakage of $\vec{X}$ direction can be prevented. The fringing capacitance formed by such periodical slot structure is shown in FIG. 8. That is, fringing of C1 and C2 is produced between the front panel 1' and slots 5'*d*, and fringing of C3 and C4 is produced between slots 5'*c*, and the vertical portion 4*d* of the external plate member 4 of the recessed chamber 6 (FIG. 8**).

A matter that such periodical slot structure can be operated as a filter is seen in Floquet's Theorem. That is, in the structure, when w-$\beta$ relation (Dispersion relation) is induced, $\beta$ becomes an imaginary number at a certain band. This region is that the electromagnetic wave energy is attenuated, wherein w-$\beta$ relation becomes a function of the width D1 of the vertical portion 5'*c* of the stepped portion 5' and width D2 of the slot 5'*d* as shown in FIG. 5. It is also a function of the gap between the front panel 1' and the vertical portion 5'*c*. Therefore, when the electromagnetic wave energy is made to be attenuated in the vicinity of 2450 MHz of the radio frequency used for the microwave oven, since the periodical structure operates as the band stop filter, the leakage of electromagnetic wave energy proceeding to $\vec{X}$/Z direction can be prevented.

Figure 9:
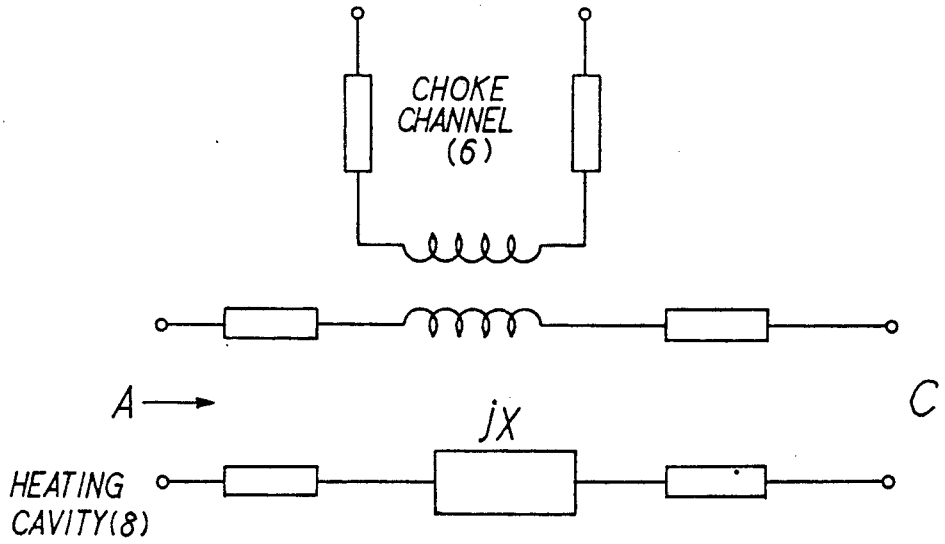
FIG. 9 is an explanatory diagram illustrating a flow of electromagnetic wave energy leaked to the exterior from the interior of a heating cavity according to the present invention.

Furthermore, for the choke of $\vec{Z}$ direction, the λg/4 choke seal serves main role and the flow of electromagnetic wave energy from the heating cavity 8 can be expressed as shown in FIG. 9. That is, when the electromagnetic wave flows from point A of the heating cavity 8 to point c of exterior, the impedance relation at the heating cavity 8 can be expressed by jX. .When a point that jX becoming infinity is positioned on the A→C path, the AC transmission line is opened and the leakage of radio frequency energy is prevented.

The λg/4 choke seal includes two capacitive seals 9 and 10 as described above and the stepped portion 5' formed with the slots 5'*d* having a predetermined periodical interval. When the choke seal of such structure is formed, the length L and width W of the recessed chamber 6 and the height H between the lower horizontal portion 5'*b* of the stepped portion 5, and the lower horizontal surface 4*c* of the external plate member 4 are important factors and those of important factors in the formation of the periodical slots 5'*d* and the first and second capacitive seals 9 and 10 are D1, D2, E, and the upper vertical portion of the internal plate body 5 as shown in FIG. 5. These respective factors are suitably controlled, whereby optimum state is observed so that the examination for obtaining optimum structure of the choke seal is carried out by the equipment as shown in FIG. 6, wherein reference numeral 11 denotes a radio frequency detector and 12 is a spacer.

Figure 7:
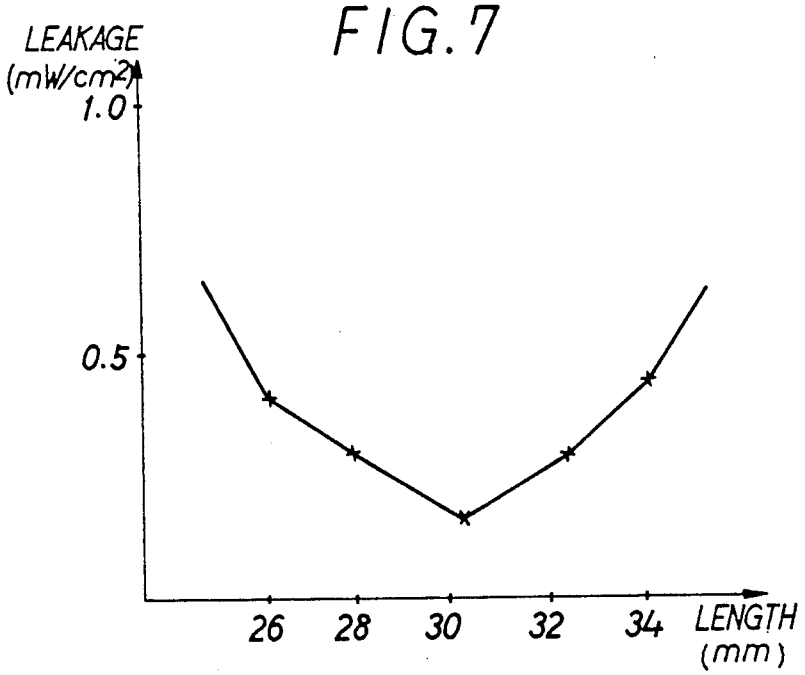
FIG. 7 is a graph illustrating the leakage with respect to the length of the choke seal measured by the equipment of FIG. 6.

FIG. 7 shows the change of leakage according to the length L at a state that various factors are set, wherein it can be seen that the leakage is minimum when the length L is λg/4.

As described above in detail, the electromagnetic wave energy leakage preventing device according to the present invention has an effect that slot structure having predetermined periodical intervals and the auxiliary capacitive seal are formed, whereby the leakage of electromagnetic wave energy to x direction and z direction can be simultaneously prevented therefrom so that the perfect radio frequency leakage preventing effect can be obtained without using the expensive ferrite rubber. Furthermore, an effect also can be obtained that the stepped portion bent in two steps to the internal plate member of the recessed chamber, thereby rendering to reduce the width of the recessed chamber so that the thickness of the door of the microwave oven can be made thinner than the conventional device.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. In a microwave oven including a source of microwave energy with a predetermined frequency, a heating cavity for receiving items to be heated by the microwave energy and having an access opening, a door for opening and closing the access opening, and a door seal arrangement for preventing the leakage of microwave energy through a door gap, said door seal arrangement of a microwave oven comprising:

a recessed chamber having a choke function, said recessed chamber being defined substantially rectangular configuration by an internal plate member and an external plate member, the length of said recessed chamber being substantially λ/4 of the effective wavelength for minimizing the leakage path of the microwave energy in the longitudinal direction, a stepped portion formed by said internal plate member, said stepped portion having upper and lower horizontal portions, a vertical portion, and first and second capacitive seals for changing its capacitance by said stepped portion, whereby the propagation path makes a characteristic impedance different from each other, a plurality of slots formed at said lower horizontal portion and said vertical portion of said internal plate member, said plurality of slots being formed at predetermined periodical intervals, whereby a band stopping filter is gained for suppressing the microwave energy proceeding to the x-direction, a C-shaped member disposed at the bottom end portion of said external plate member for forming the second capacitive seal between a front panel of said heating cavity, and a choke cover for blocking an opening of said recessed chamber, said choke cover being located between said C-shaped member and said lower horizontal portion of said stepped portion.

* * * * *